US007954604B2

(12) United States Patent
Mishima

(10) Patent No.: US 7,954,604 B2
(45) Date of Patent: Jun. 7, 2011

(54) ELEVATOR SPEED CONTROL DEVICE, ELEVATOR SPEED CONTROLLING METHOD AND ELEVATOR SPEED CONTROLLING PROGRAM

(75) Inventor: Koichi Mishima, Yokohama (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 686 days.

(21) Appl. No.: 11/995,265

(22) PCT Filed: Jul. 6, 2006

(86) PCT No.: PCT/JP2006/313493

§ 371 (c)(1),
(2), (4) Date: Jan. 10, 2008

(87) PCT Pub. No.: WO2007/007637

PCT Pub. Date: Jan. 18, 2007

(65) Prior Publication Data

US 2009/0255765 A1 Oct. 15, 2009

(30) Foreign Application Priority Data

Jul. 11, 2005 (JP) ..... 2005-202271

(51) Int. Cl.
*B66B 1/28* (2006.01)

(52) U.S. Cl. ..... 187/293; 187/393

(58) Field of Classification Search ..... 187/247, 187/281, 284, 289–293, 296, 297, 277, 391–393; 318/798–815; 361/23, 31, 33
See application file for complete search history.

(56) References Cited

U.S. PATENT DOCUMENTS

| | | | | |
|---|---|---|---|---|
| 3,665,277 | A * | 5/1972 | Velazquez | 318/447 |
| 4,373,610 | A * | 2/1983 | Ishii | 187/297 |
| 4,833,380 | A * | 5/1989 | Magee | 318/484 |
| 4,982,816 | A * | 1/1991 | Doi et al. | 187/296 |
| 5,325,036 | A * | 6/1994 | Diethert et al. | 318/802 |
| 6,605,918 | B2 * | 8/2003 | Mayhew et al. | 318/727 |
| 6,924,613 | B2 * | 8/2005 | Jonsson et al. | 318/432 |
| 7,588,125 | B2 * | 9/2009 | Ueda et al. | 187/293 |

FOREIGN PATENT DOCUMENTS

| | | | |
|---|---|---|---|
| EP | 0 607 646 | B1 | 7/1994 |
| JP | 3-036177 | A | 2/1991 |
| JP | 5-017079 | A | 1/1993 |
| JP | 9-002753 | A | 1/1997 |
| JP | 2003-192246 | A | 7/2003 |
| JP | 2004-010335 | A | 1/2004 |
| TW | 376904 | | 12/1999 |

OTHER PUBLICATIONS

Chinese Office Action with English Translation, dated Dec. 25, 2009, 12 pages.

* cited by examiner

*Primary Examiner* — Jonathan Salata
(74) *Attorney, Agent, or Firm* — Foley & Lardner LLP

(57) ABSTRACT

An elevator speed governor for an elevator in which an elevator car (1) is attached to one end of a rope (2) having a counterweight (3) on the other end and driven by a motor (5) via the rope (2) comprises a motor current detector (15) that detects a motor current of the motor (5), a target speed determining section (11) that determines a target speed in accordance with the motor current detected by the motor current detector (15), and a motor control section (13) that controls the motor (5) so that the elevator car (1) moves at the target speed determined by the target speed determining section (11).

13 Claims, 3 Drawing Sheets

ELEVATOR SPEED CONTROL DEVICE, ELEVATOR SPEED CONTROLLING METHOD AND ELEVATOR SPEED CONTROLLING PROGRAM

TECHNICAL FIELD

The present invention relates to an elevator speed governor for an elevator whose elevator car is motor-driven, a speed governing method and a speed governing program product incorporated in the elevator speed governor.

BACKGROUND ART

An elevator is hoisting machinery for conveying passengers and/or freight to different floors by motor-driving an elevator car where the passengers and freight are loaded, the elevator car being connected with a hoist rope having a counterweight on the other end. In such an elevator, an elevator car speed is generally controlled to be constant at a predetermined rated speed, which is referred to as the maximum speed at which a loaded elevator car moves upward.

When selecting a motor that drives an elevator car, a required capacity is calculated from a rated speed predetermined for an elevator car and its maximum laden weight. Then, based on the calculation, such a motor is selected that has enough power to surely drive the elevator car at the rated speed even when the passengers and/or freight are loaded therein to the maximum laden weight. There is disclosed an example of an elevator speed governor that controls an elevator speed depending on its laden weight in Japanese Patent Application Laid-open Publication No. 2004-10335.

However, the elevator car is rather rarely loaded to the maximum laden weight, and in many cases, the car is driven while being loaded to a laden weight lower than the maximum.

In addition, while the load applied to the motor varies depending on the laden weight thereof, a rope weight and friction causing in a sieve or the like cannot be disregarded as a load affecting factor to the motor. Therefore, the elevator car speed cannot be controlled appropriately if the control relies only on the laden weight, as is the case with conventional elevators.

DISCLOSURE OF INVENTION

The present invention has been made in view of the above disadvantage and the objective thereof is to provide an elevator speed governor, a speed governing method and a speed governing program incorporated in the elevator speed governor that improve elevator service by exploiting the full use of motor capacity.

According to a first aspect of the present invention, there is provided an elevator speed governor for an elevator in which an elevator car is attached to one end of a rope having a counterweight on the other end and driven by a motor via the rope. This elevator speed governor comprises a motor current detector that detects a motor current of the motor, a target speed determining section that determines a target speed in accordance with the motor current detected by the motor current detector, and a motor control section that controls the motor so that the elevator car moves at the target speed determined by the target speed determining section.

According to a second aspect of the present invention, there is provided a method of governing a speed of an elevator car in an elevator in which the elevator car is attached to one end of a rope having a counterweight on the other end and driven by a motor via the rope. This method comprising detecting a motor current of the motor, determining a target speed at which the elevator car moves in accordance with the measured motor current, and controlling to move the elevator car at the determined target speed.

According to a third aspect of the present invention, there is provided a n elevator speed governing program incorporated into an elevator speed governor of an elevator in which the elevator car is attached to one end of a rope having a counterweight on the other end and driven by a motor via the rope. This program comprises causing the elevator speed governor to perform a first function that determines in accordance with a motor current detected by a motor current detector a target speed at which the elevator car is to move, and a second function that controls the elevator car to move at the determined target speed.

According to the present invention, since the rated speed (target speed) is determined in accordance with the motor current, when there is caused redundant capacity of the motor that drives the elevator car, the capacity can be efficiently utilized to increase the speed of the elevator car. Therefore, the elevator to which the present invention is applied can move its elevator car to a destination floor as fast as possible, thereby improving elevator service.

BEST MODE FOR CARRYING OUT THE INVENTION

Referring to accompanying drawings, preferred embodiments according to the present invention will be described hereinafter. It should be noted that the accompanying drawings are not to scale but are to merely outline the embodiments and are not intended to portray the specific parameters or the structural details of the embodiments, which can be determined by one of those skilled in the art through examination of the information herein.

The inventors of the present invention have carried out intensive investigations and thus acquired the following knowledge:

(a) When not many passengers get in an elevator car, driving machinery including the elevator motor will experience less load and thus the elevator car speed can be increased by utilizing the remaining capacity of the motor. As a result, the passengers can speedily get to their destination floor, which is indicative of an improved elevator service.

(b) A load applied to the driving machinery can be calculated through a motor current during an acceleration period of the elevator car.

An elevator can be controlled in such a way that the elevator speed can be raised, if the motor current during an acceleration period is within a certain range with reference to the motor current when the elevator car balanced in weight with the counterweight is moving.

(c) An elevator car can be controlled in such a way that the elevator car is halted upon detecting an excessive current during its operation, the excessive current being determined in accordance with the maximum motor current during a normal operation of the elevator car.

(d) Based upon not the laden weight but the motor current, the load applied to the driving machinery or the like is calculated, which makes it possible to control the elevator car speed without being heavily influenced by an accidental error in laden weight detection and changes over the ages.

The present invention has been made based on the above knowledge and preferred embodiments thereof will be detailed hereinafter.

Figure 1:
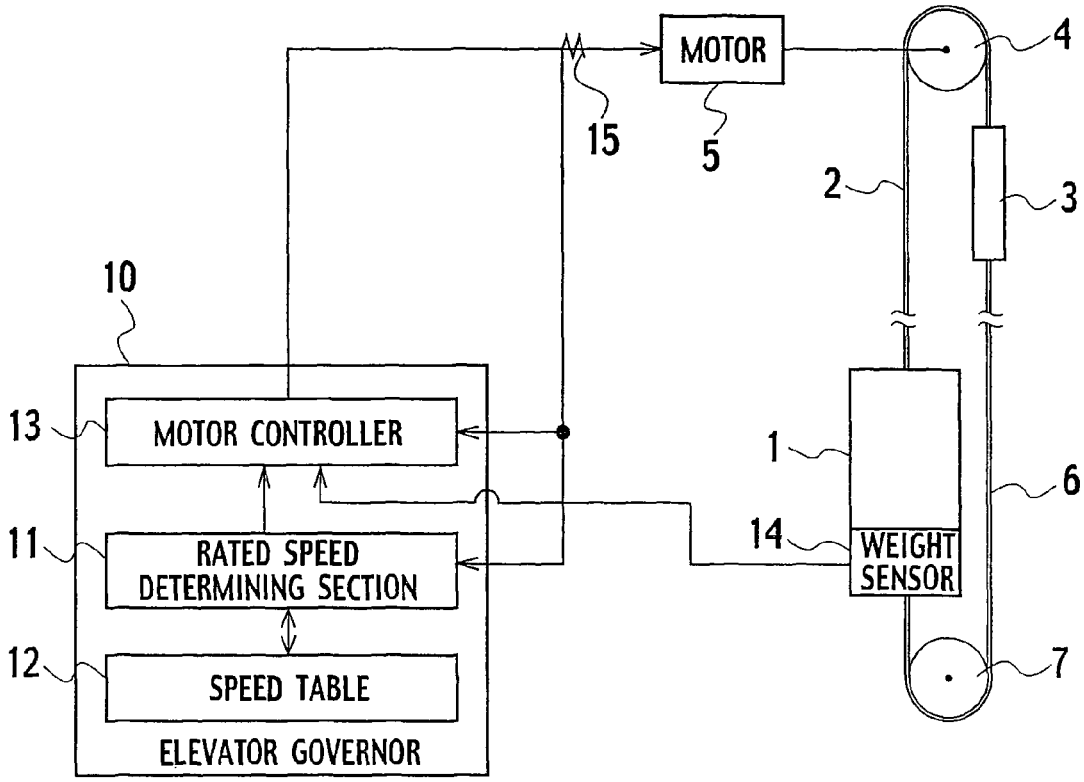
FIG. 1 is a schematic view of an elevator to which the present invention is applied.

FIG. 1 is a schematic view of an elevator to which the present invention is applied. This elevator is comprised of an elevator car 1 in which passengers and/or packages are loaded. The elevator car 1 has a main rope 2 that is connected at one end thereof to hang and support the elevator car 1 in an elevator shaft. The other end of the main rope 2 is fastened to a counterweight 3 to make a balance with the elevator car 1.

Above the elevator car 1 and the counterweight 3, there is provided a main sheave 4 around which the main rope 2 is wound. The main sheave 4 is attached to the rotation axis of the motor 5 and driven by the motor 5 to rotate to send out the main rope 2. The main rope sent out from the main sheave 4 moves the elevator car 1 up and down in the elevator shaft.

In addition, to the lower end portions of the elevator car 1 and the counterweight 3 is connected one end and the other end of a compensating rope 6, respectively. The compensating rope 6 serves to reduce variations of the weight balance between the elevator car 1 and the counterweight 3, the variations being associated with movement of the elevator car. Also, the compensating rope 6 is stretched across between the elevator car 1 and the counterweight 3 via a compensating sheave 7 with a predetermined tension applied thereto.

The motor 5 is composed of a permanent magnet type synchronous motor and controlled by an elevator governor 10.

The elevator governor 10 determines a destination floor in response to a hall call or a car call by elevator users and carries out various controls required to drive the motor 5 to move the elevator car 1 to the destination floor. Specifically, the elevator according to this embodiment, the elevator governor 10 is provided with a current sensor 15 to detect a motor current of the motor 5 as well as a rated speed determining section 11, a speed table 12, and a motor control section 13. With such a configuration, the motor control section 13 serves to control the motor 5 to drive in such a way that the elevator car 11 moves at a rated speed determined by the rated speed determining section 11. In addition, the elevator according to this embodiment is provided with a load sensor 14 to detect a laden weight of the elevator car 1.

Figure 2:
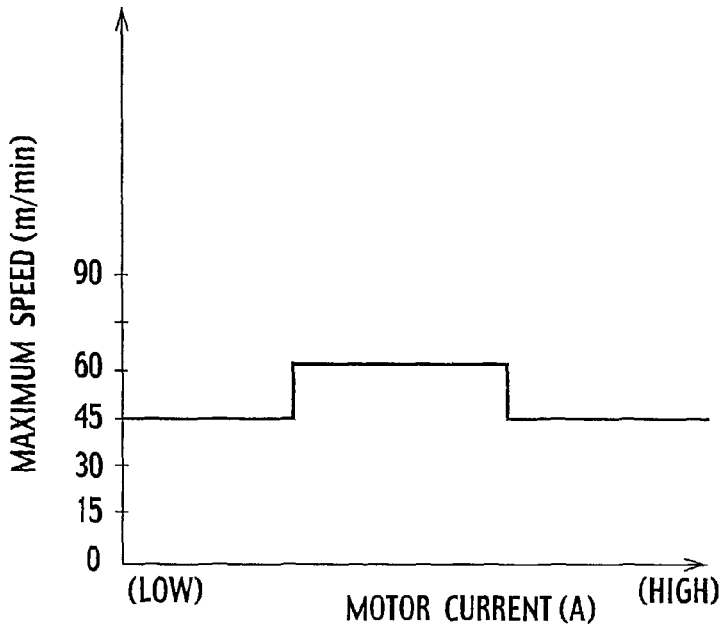
FIG. 2 illustrates a speed pattern in which a maximum speed that is selectable for an elevator car is correlated with a motor current.

The rated speed determining section 11 determines a rated speed of the elevator car 1 in accordance with a current value detected by the current sensor 15. The rated speed is a speed of the elevator car 1 except for during a period of acceleration and deceleration, and selected for example from 45 m/min., 60 m/min., and 90 m/min. or the like. Among these specific speeds, a speed to be used as the rated speed at which the elevator car 1 is moving is determined by the current value of the motor 5 at the time. For example, the rated speed may be determined as 45 m/min in an acceleration period with a lower motor current, as shown in FIG. 2. On the other hand, when the motor current is equal to or higher than a certain value that means high loads during power running, or equal to or lower than another value that means high loads during regeneration, the rated speed may be determined as 60 m/min. The speed pattern exemplified in FIG. 2 is set in a form of the speed table 12 (FIG. 1).

The motor control section 13, which is provided with an inverter or the like, controls the motor that drives the elevator car 1 via the main sheave 4 and the main rope 2 so that the elevator car 1 moves at the rated speed determined by the rated speed determining section 11. Specifically, the motor control section 13 carries out a current control on the basis of the current value detected by the current sensor 15 and a feedback-control while monitoring a rotation speed of the motor 5 so that the rotation speed corresponds to the rated speed determined by the rated speed determining section 11.

By the way, the motor control section 13 and the rated speed determining section 11 in the elevator governor 10 is realized in such a way that a processor provided in the elevator governor 10 carries out procedures specified by a speed governing program incorporated in the elevator governor 10. The speed governing program may be incorporated in advance in a form of a program ROM (read only memory) or written into a memory in the elevator governor 10 from a recording media.

Figure 3:
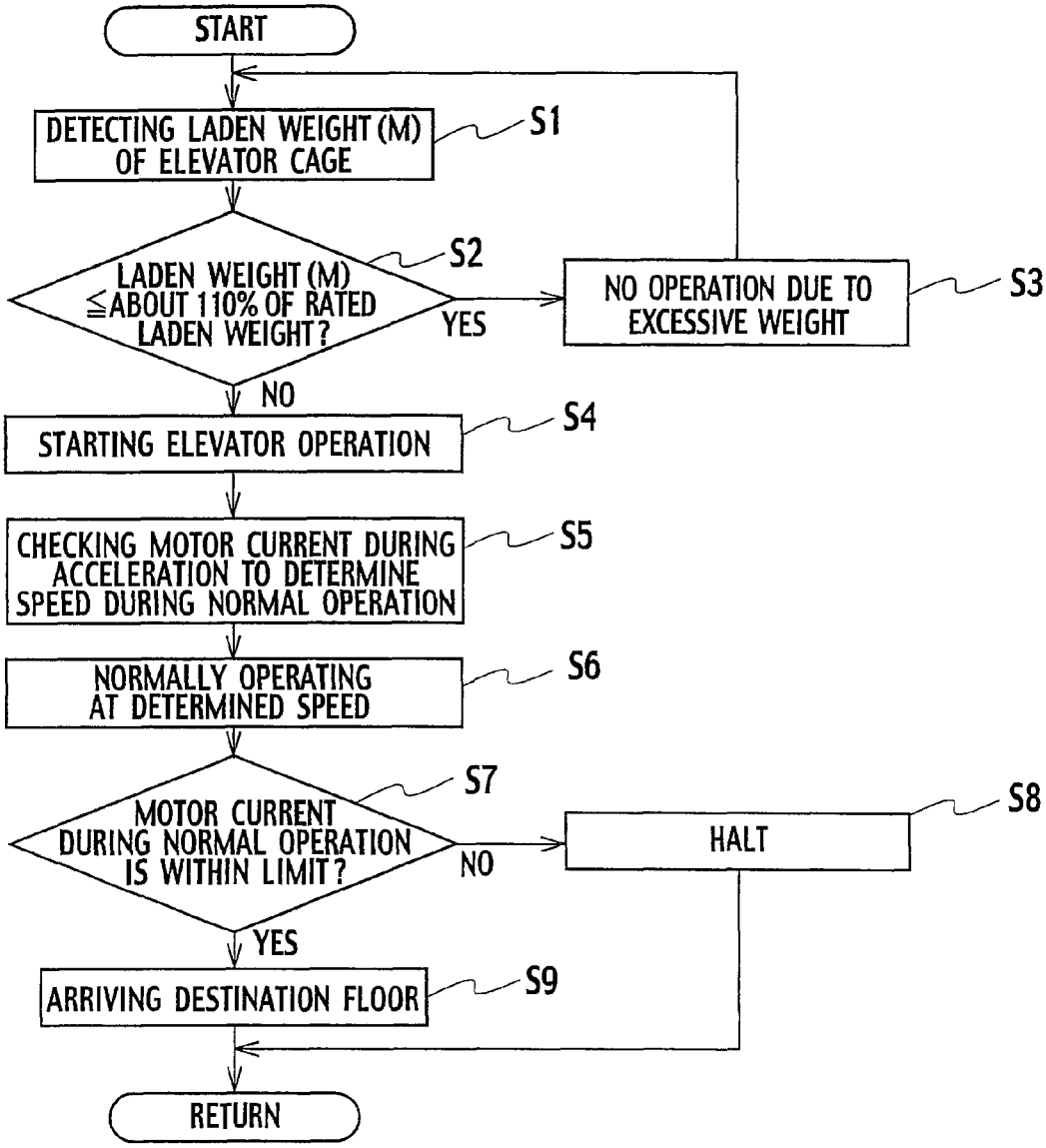
FIG. 3 is a flowchart illustrating a series of procedures to move the elevator car to a destination floor in the elevator to which the present invention is applied.

Next, a series of procedures to move the elevator car 1 to a destination floor in the elevator to which the present invention is applied will be described hereinafter referring to a flowchart shown in FIG. 3.

First of all, a laden weight M of the elevator car 1 is detected by the load sensor 14 when the car 1 stops at a floor (Step S1). Then, the laden weight M is determined if it is equal to or greater than 110% of the rated laden weight (Step S2). When M is equal to or greater than 110%, the elevator car 1 is overloaded and thus remains at the floor (Step S3).

Figure 4:
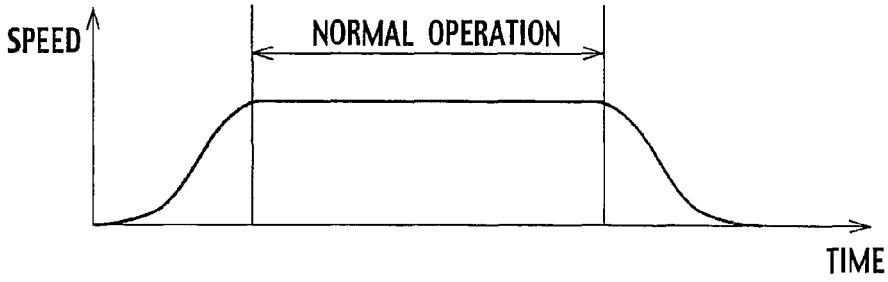
FIG. 4 illustrates a motor speed as function of time.

When the elevator car 1 is not overloaded, the elevator car 1 starts to move (Step S4) and the current sensor 15 detects a motor current at the time of acceleration of the elevator car 1. When the elevator car 1 is gaining speed as shown in FIG. 4, the speed table 12 is referred to based on the motor current value detected when the elevator car 1 passes through a predetermined point or section of the elevator shaft and a target speed of the elevator car 1 at the time of normal-speed operation is set (Step S5). Then, the motor control section 13 controls the elevator car 1 to move at the set speed during normal-speed operation (Step S6).

The current sensor 15 detects a motor current of the motor 5 even during the normal-speed operation. When the detected motor current exceeds a predetermined value determined for the car speed of the elevator car 1, the elevator car 1 is halted (Step S8). When the detected motor current is equal to or lower than the predetermined value, the elevator car 1 continues to operate to arrive at the destination floor (Step S9).

According to this embodiment, when the elevator car 1 moves to the destination floor, the motor current of the motor 5 is detected and the detected current value is utilized as a basis to determine the rated rotation speed (target speed) of the motor 5. Therefore, the elevator car 1 is able to get to the destination floor as fast as possible, thereby improving elevator service.

In addition, in this elevator, the elevator governor 10 is provided with the speed table 12 that associates the motor current of the motor that drives the elevator car 1 with the maximum rated speed that can be determined within the capacity of the motor and the speed table 12 is referred to by the rated speed determining section 11 in order to determine the rated speed of the elevator car 1 when moving to the destination floor. Therefore, the rated speed is readily and precisely determined in accordance with the motor current of the motor 5.

Moreover, the motor current of the motor 5 is detected even during the normal-speed operation and the elevator car 1 is controlled in such a way that the elevator car 1 is halted when the detected motor current exceeds the predetermined value for the car speed. Therefore, the capacity of the motor 5 can be harnessed as effectively as possible to increase the speed of the elevator car 1 while assuring safety.

Figure 5:
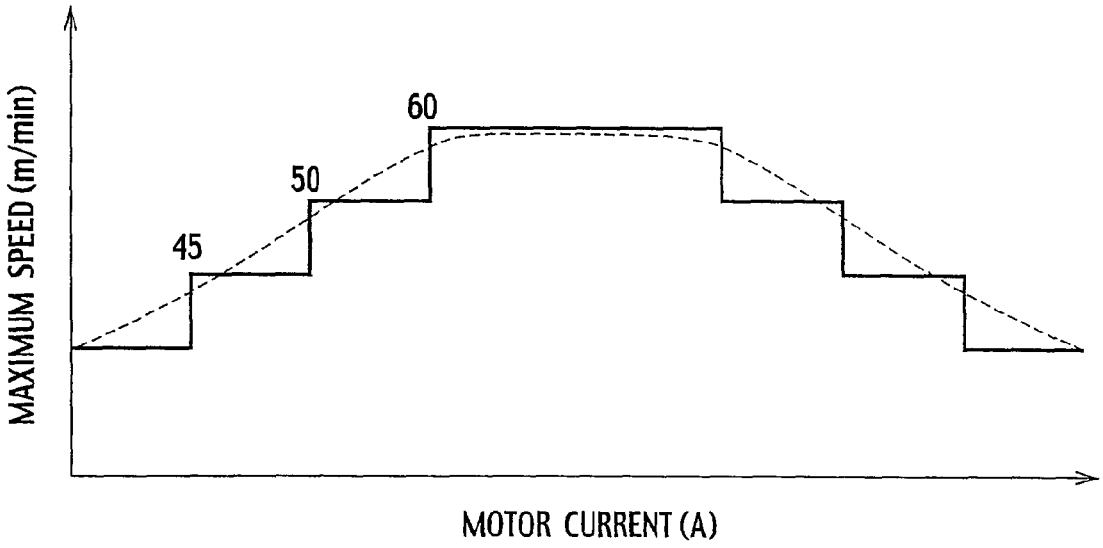
FIG. 5 illustrates another speed pattern in which a maximum speed that is selectable for an elevator car.

By the way, a speed pattern to be set in the speed table 12 is not limited to one exemplified in FIG. 2 but may be another one, for example, shown by the solid line in FIG. 5, in which the speed of the elevator car 1 is increased stepwise from 45 m/min. to 50 m/min. and then to 60 m/min. in accordance with the motor current and decreased to 50 m/min. and then to 45 m/min. when the motor current exceeds a predetermined value. In addition, the speed of the elevator car 1 may be changed not stepwise but gradually in accordance with the motor current as shown by the dotted line in FIG. 5.

INDUSTRIAL APPLICABILITY

The present invention is applicable to an elevator for passengers or freight in which an elevator car is attached to one end of a rope having a counterweight on the other end and driven by a motor via the rope. In such an elevator to which the present invention is applied, its elevator car can carry passengers and/or freight efficiently by harnessing a capability of the motor that drives the elevator car, thereby contributing to an improved elevator service.

The invention claimed is:

1. An elevator speed controlling device for an elevator in which an elevator car is attached to one end of a rope having a counterweight on the other end and driven by a motor via the rope, the elevator speed governor comprising:

a motor current detector that detects a motor current of the motor, a target speed determining section that determines a target speed in accordance with the motor current detected by the motor current detector, and a motor control section that controls the motor so that the elevator car moves at the target speed determined by the target speed determining section, wherein the target speed is the maximum speed determined within the capacity of the motor in detection of the motor current.

2. An elevator speed controlling device as recited in claim 1, wherein the target speed determining section determines the target speed on the basis of a motor current detected by the motor current detector when the elevator car is moving at a predetermined acceleration.

3. An elevator speed controlling device as recited in claim 2, further comprising a speed table that associates the motor current with the target speed so that a speed of the elevator car becomes a normal rated speed when the motor current of the motor is equal to or larger than a predetermined value that means high load during power running or when the motor current of the motor is equal to or smaller than a predetermined value that means high load during degeneration, wherein the target speed determining section refers to the speed table to determine the target speed.

4. An elevator speed controlling device as recited in claim 1, wherein the motor control section controls to bring the elevator car into halt when the motor current detected at time of the elevator car moving at the target speed exceeds a predetermined value determined for the elevator car.

5. A method of controlling a speed of an elevator car in an elevator in which the elevator car is attached to one end of a rope having a counterweight on the other end and driven by a motor via the rope, the method comprising:

detecting a motor current of the motor, determining a target speed at which the elevator car moves in accordance with the measured motor current, and controlling to move the elevator car at the determined target speed, wherein the target speed is the maximum speed determined within the capacity of the motor in detection of the motor current.

6. A method as recited in claim 5, wherein the determining of the target speed is based on the motor current value detected when the elevator car is moving at a predetermined acceleration.

7. A method as recited in claim 6, further comprising providing a speed table that associates the motor current with the target speed so that the speed of the elevator car becomes a rated speed when the motor current is equal to or larger than a predetermined value that means high load during power running or when the motor current is equal to or smaller than a predetermined value that means high load during degeneration, wherein the target speed is determined in reference with the speed table.

8. A method as recited in claim 5, further comprising controlling to bring the elevator car into halt when the motor current detected at time of the elevator car moving at the target speed exceeds a predetermined value determined for the elevator car.

9. An elevator speed controlling program incorporated into an elevator speed governor of an elevator in which the elevator car is attached to one end of a rope having a counterweight on the other end and driven by a motor via the rope, the program comprising causing the elevator speed governor to perform a first function that determines in accordance with a motor current detected by a motor current detector a target speed at which the elevator car is to move, and a second function that controls the elevator car to move at the determined target speed,, wherein the target speed is the maximum speed determined within the capacity of the motor in detection of the motor current.

10. An elevator speed controlling device as recited in claim 2, wherein the motor control section controls to bring the elevator car into halt when the motor current detected at time of the elevator car moving at the target speed exceeds a predetermined value determined for the elevator car.

11. An elevator speed controlling device as recited in claim 3, wherein the motor control section controls to bring the elevator car into halt when the motor current detected at time of the elevator car moving at the target speed exceeds a predetermined value determined for the elevator car.

12. A method as recited in claim 6, further comprising controlling to bring the elevator car into halt when the motor current detected at time of the elevator car moving at the target speed exceeds a predetermined value determined for the elevator car.

13. A method as recited in claim 7, further comprising controlling to bring the elevator car into halt when the motor current detected at time of the elevator car moving at the target speed exceeds a predetermined value determined for the elevator car.

* * * * *